US006063741A

United States Patent [19]

Naitoh et al.

[11] Patent Number: 6,063,741

[45] Date of Patent: May 16, 2000

[54] ENGINE OIL COMPOSITION

[75] Inventors: Yasushi Naitoh, Toda; Kenyu Akiyama, Toyota, both of Japan

[73] Assignees: Japan Energy Corporation, Tokyo; Toyota Jidosha Kabushiki Kaisha, Toyota, both of Japan

[21] Appl. No.: 08/965,998

[22] Filed: Nov. 7, 1997

Related U.S. Application Data

[63] Continuation-in-part of application No. 08/522,657, Sep. 1, 1995, abandoned.

[30] Foreign Application Priority Data

Sep. 5, 1994 [JP] Japan ..... 6-211264

[51] Int. Cl.[7] ..... C10M 137/00

[52] U.S. Cl. ..... 508/365; 508/376; 508/378; 508/569; 508/570; 508/572

[58] Field of Search ..... 508/364, 365, 508/371, 376, 378, 569, 570, 572

[56] References Cited

U.S. PATENT DOCUMENTS

| | | | |
|---|---|---|---|
| 3,533,943 | 10/1970 | Papay | 508/572 |
| 3,966,623 | 6/1976 | Krug et al. | 252/391 |
| 4,178,258 | 12/1979 | Papay et al. | 508/363 |
| 4,200,543 | 4/1980 | Liston et al. | 508/569 |
| 4,360,438 | 11/1982 | Rowan et al. | 508/364 |
| 4,395,343 | 7/1983 | de Vries et al. | 508/230 |
| 4,529,526 | 7/1985 | Inoue et al. | 508/364 |
| 4,609,480 | 9/1986 | Hata et al. | 508/273 |
| 4,846,983 | 7/1989 | Ward, Jr. | 508/363 |
| 4,959,166 | 9/1990 | Miniamitani et al. | 508/206 |

FOREIGN PATENT DOCUMENTS

| | | |
|---|---|---|
| 0 113 045 | 7/1984 | European Pat. Off. . |
| 0 562 172 | 9/1993 | European Pat. Off. . |
| 3-23595 | 3/1991 | Japan . |
| 5-279686 | 10/1993 | Japan . |
| 5-83599 | 11/1993 | Japan . |
| 8-253785 | 10/1996 | Japan . |
| WO 96/06904 | 3/1996 | WIPO . |

OTHER PUBLICATIONS

Derwent Publixations Ltd., Search Ch, Week 8630, AN 86–194186, Abstract. Date Unknown.

English–language Abstract of JP 5–279686. Oct. 1993.

*Primary Examiner*—Gabrielle Brouillette
*Assistant Examiner*—Cephia D. Toomer
*Attorney, Agent, or Firm*—Oliff & Berridge, PLC

[57] ABSTRACT

An engine oil composition is composed of: (1) at least one oil selected from the group consisting of a mineral oil and a synthetic lubricant as a base oil; (2) a molybdenum dithiocarbamate in an amount of 50 to 2000 ppm by weight when calculated as molybdenum (Mo), relative to the total weight of the engine oil composition; (3) zinc dithiophosphate in an amount of 0.01 to 0.2 wt % when calculated as phosphorus (P), relative to the total amount of the engine oil composition; and (4) an ashless organic polysulfide compound in an amount of 0.01 to 0.4 wt % when calculated as sulfur (S), relative to the total amount of the engine oil composition.

19 Claims, 2 Drawing Sheets

ENGINE OIL COMPOSITION

This is a Continuation-in-Part of application Ser. No. 08/522,657, filed Sep. 1, 1995, now abandoned.

BACKGROUND OF THE INVENTION

1. Field of Invention

The present invention relates to an engine oil composition for automobiles. More particularly, the invention relate to the long life and fuel-saving engine oil composition which can suppress the friction loss in the engine to a low level for a long time.

2. Description of Related Art

With the progress of the engines, the automobile engine oil compositions (hereinafter referred to briefly as "engine oil compositions") have been required to possess various performances such as wear resistance, oxidation stability, and detergent dispersibility. Recently, in order to suppress the earth from getting warmer due to increase in the content of $CO_2$ in the atmosphere, how to improve the mileage of the automobiles is an important problem. Accordingly, the fuel saving has been also strongly required with respect to the engine oils.

Ordinarily, the engine oil composition is composed of a mixture of a base oil purified from petroleum, added with additives such as detergent, an antioxidant, an anti-wear agent, and a viscosity index improver. In order to increase the fuel efficiency (mileage) of the engine oil, for example, the viscosity of the engine oil is lowered by decreasing the viscosity of the base oil or changing the viscosity index improver. However, friction cannot be reduced in the case of the above ordinary engine oil composition in such an area as a boundary lubricating condition where the viscosity does not contributes to mitigation of the friction. Consequently, a friction modifier (FM) has recently come to be added so as to reduce the wearing in the boundary lubricating area. With respect to the friction modifiers, it is known that organic molybdenum compound such as molybdenum dithiocarbamate (MoDTC) and oxymolybdenum organo phosphodithioate sulfide (MoDTP) are highly effective as described in JP-B 3-23595.

However, as the time passes, each of the above organic molybdenum compounds used in the engine oil composition is consumed. Therefore, though the fresh engine oil composition gives a low fuel consumption rate, such a low fuel consumption rate of the engine oil composition is deteriorated with the lapse of time. In order to lessen the above drawback, it may be considered that the addition amount of the organic molybdenum compound in a fresh oil is increased. However, if the addition amount of the organic molybdenum compound is merely increased, the cost of the product becomes higher, which is economically unfavorable. Further, among the organic molybdenum compounds, MoDTP contains phosphorus, so that a phosphorus compound may deposit on the surface of an exhaust gas catalyst to deteriorate the catalytic activity. Therefore, the addition amount of the MoDTP cannot be increased beyond a given level.

On the other hand, since MoDTC contains no phosphorus, increase in its addition amount does not cause decrease in the catalytic activity. However, since MoDTC has a small friction-mitigating effect, it may be considered that MoDTC is used in combination with zinc dithiophosphate (ZnDTP) as an anti-wear agent so as to supplement the wear-mitigating effect of the former. ZnDTP has been frequently used, as antioxidant and antiwear agent, in the engine oil compositions. However, since ZnDTP contains phosphorus and gives adverse influence upon the exhaust gas catalyst as mentioned above, its addition amount is limited so that good friction-mitigating effect cannot unfavorably be maintained for a long time. Further, it is proposed that MoDTC be used in combination with a sulfur-based extreme pressure additive (See JP-B 5-83599). This combination does not afford adverse effect upon the exhaust gas catalyst, but it encounters a practically great problem upon the engine oil composition in that wear largely occurs in the valve train system.

SUMMARY OF THE INVENTION

Under the circumstances, it is an object of the present invention to enable the engine oil composition to maintain the friction loss at a low level even when the engine oil composition is used for a long time.

Furthermore, it is another object of the present invention to enable the engine oil composition to maintain the friction loss at a low level for a long time, while the addition amount of the friction modifier is kept at the same level as formerly employed.

It is still another object of the present invention to enable the engine oil composition to maintain the friction loss at a low level for a long time without affording adverse influence upon the catalytic activity for exhaust gases.

Having made strenuous investigation to accomplish the above-mentioned objects, the present inventors discovered that the combination of MoDTC and ZnDTP with a polysulfide compound can remarkably prolong the performance of the low fuel consumption rate, that is, can maintain the friction-mitigating effect of the engine oil for a long time without affording adverse influence upon the exhaust gas catalyst. Based on this discovery, the inventors have accomplished the present invention.

That is, the present invention relates to the engine oil composition comprising (1) at least one oil selected from the group consisting of a mineral oil and a synthetic lubricant as a base oil; (2) a molybdenum dithiocarbamate in an amount of 50 to 2000 ppm by weight when calculated as molybdenum (Mo), relative to the total weight of the engine oil composition; (3) zinc dithiophosphate in an amount of 0.01 to 0.2 wt % when calculated as phosphorus (P), relative to the total amount of the engine oil composition; and (4) an ashless organic polysulfide compound in an amount of 0.01 to 0.4 wt % when calculated as sulfur (S), relative to the total amount of the engine oil composition. This engine oil composition is a long life and low fuel consumption engine oil composition which can maintain the friction loss at a low level for a long time.

These and other objects, features and advantages of the invention will be apparent from the following description of the invention with the understanding that some modifications, variations and changes of the same could easily b by the skilled person in the art.

DETAILED DESCRIPTION OF PREFERRED EMBODIMENTS

Figure 1:
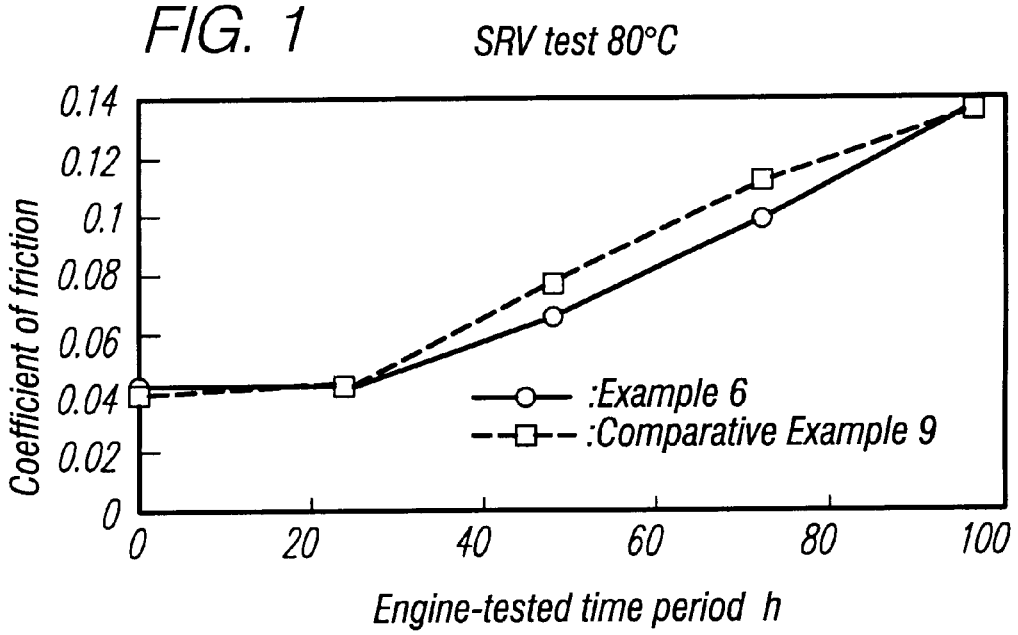
FIG. 1 shows the variation in the coefficient of friction with time of two oil compositions during engine tests.
Figure 2A:
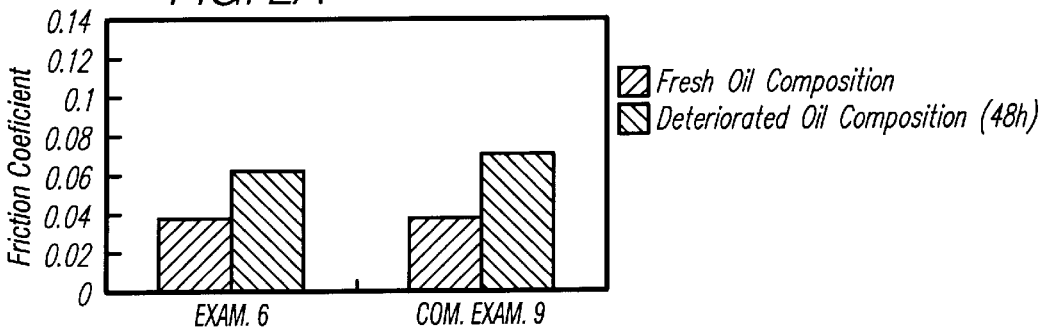
FIGS. 2A–2D compare the variation in friction coefficient with time of various oil compositions during engine tests.
Figure 2B:
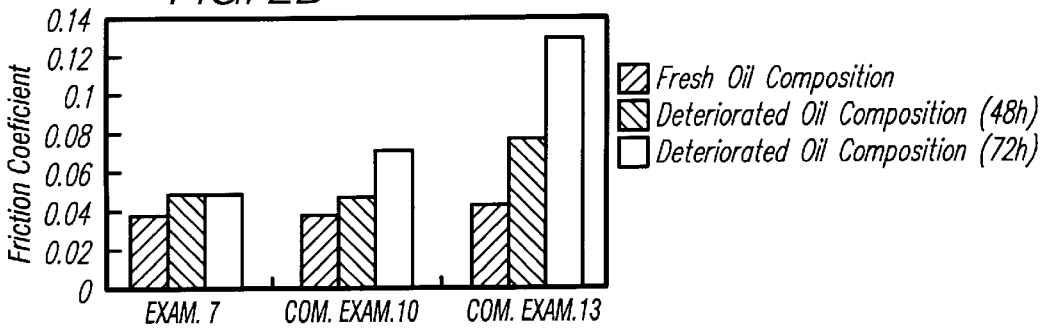
Figure 2C:
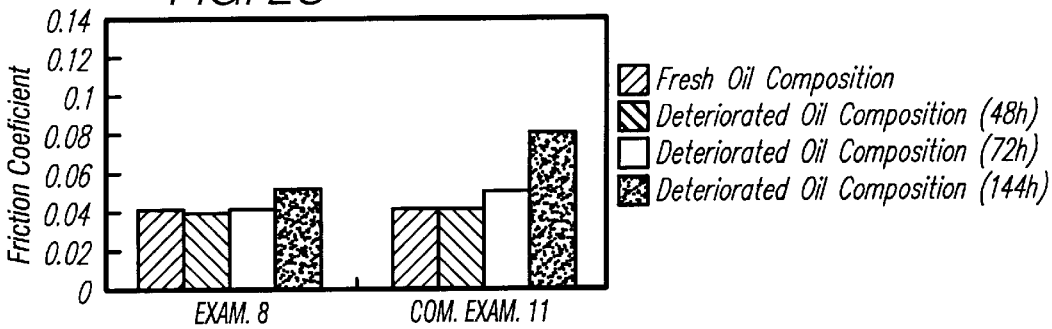
Figure 2D:
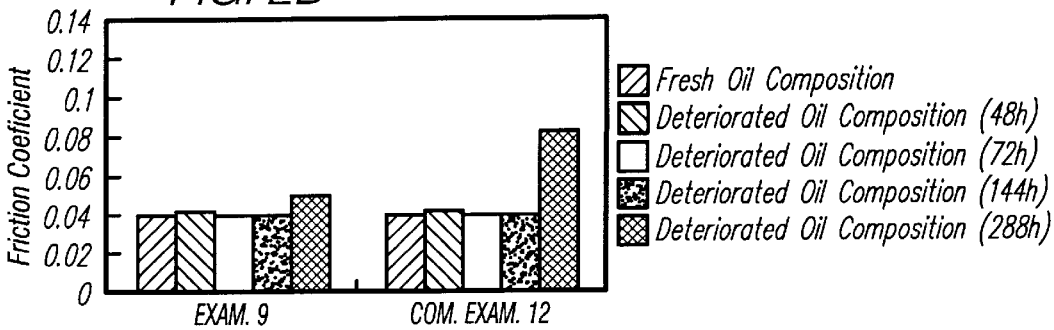

The base oil to be used in the engine oil composition according to the present invention is a mineral oil and/or a synthetic oil. As the base oil, which is used, in the engine oil composition, as a base component occupying a great part of the engine oil composition, any base oil may be used. Specifically, as the mineral oil, use may be made of a lubricant base oil which is producing by obtaining a cut through distilling an ordinary pressure distillation residue of such as a paraffinic crude oil under reduced pressure, treating the resulting cut through extraction with a solvent such as furfural, purification by hydrogenation and dewaxing with a solvent such as MEK/toluene, a lubricant base oil produced by obtaining a deasphalted oil by deasphalting the above pressure-reduced distillation residue and treating it by any of the above appropriate processes, a highly purified base oil obtained through isomerization of slack wax and dewaxing an appropriate cut of the isomerized oil with a solvent of MEK/toluene, or an appropriate mixture thereof.

As the synthetic oil, use may be made of an α-olefin oligomer, a diester synthesized from a dibasic acid such as an adipic acid and a primary alcohol, a polyol ester synthesized from a higher alcohol such as neopentyl glycol, trimethylol propane or pentaerithritol and a monobasic acid, an alkyl benzene or a polyoxy-alkylene glycol or an appropriate mixture thereof. Further, needless to say, a mixed oil obtained by appropriately combining the mineral oil with the synthetic oil may be used as a base oil for the engine oil composition according to the present invention.

The molybdenum dithiocarbamate (MoDTC) to be used as an additive in the present invention is a compound expressed by the following formula (1):

(1)

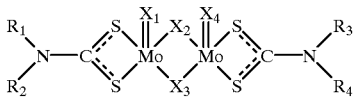

In the formula (1), $R_1$ through $R_4$ independently denote a straight-chain or branched-chain alkyl group or a straight-chain or branched-chain alkenyl group having four to eighteen carbons; and $X_1$ through $X_4$ independently denote an oxygen atom or a sulfur atom, the ratio between the number of the oxygen atom or atoms and that of the sulfur atom or atoms with respect to $X_1$ through $X_4$ being 1/3 to 3/1. As $R_1$ through $R_4$, the alkyl group is preferred. More specifically, butyl group, 2-ethylhexyl group, isotridecyl group or stearyl group may be recited. These four $R_1$ through $R_4$ existing in one molecule may be identical with or different from each other. Further, two or more MoDTCs differing in terms of $R_1$ through $R_4$ may be used in a mixed state.

MoDTC is used in the addition amount of 50 to 2000 ppm by weight, preferably 300 to 1000 ppm by weight, when calculated as molybdenum (Mo), relative to the total weight of the engine oil composition. If the addition amount is less than 50 ppm by weight, the friction reducing effect is small, whereas if it is more than 2000 ppm by weight, the friction-reducing effect is saturated and the cost increases.

The zinc dithiophosphate (ZnDTP) to be used as an additive in the present invention is a compound expressed by the formula (2):

(2)

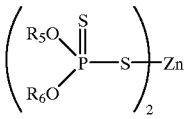

In the formula (2), $R_5$ and R6 independently denote a straight-chain or branched chain alkyl group or a straight-chain or branched chain aryl group having three to eighteen carbon atoms. As $R_5$ and $R_6$, an alkyl group, particularly, a primary alkyl group is preferred from the standpoint that the friction-mitigating performance must be maintained for a long time. More specifically, for example, propyl group, butyl group, pentyl group, hexyl group, octyl group and lauryl group may be recited. These two $R_5$ and $R_6$ existing in one molecule may be identical with or different from each other. Further, two or more kinds of ZnDTPs differing in terms of $R_5$ and $R_6$ may be used in a mixed state.

ZnDTP is added in an amount of 0.01 to 0.2 wt %, preferably 0.04 to 0.2 wt %, more preferably 0.04 to 0.1 wt % when calculated as phosphorus (P), relative to the total amount of the engine oil composition. If the addition amount is less than 0.01 wt %, the wear preventing performance of the engine oil composition for the valve train system is deteriorated. On the other hand, if it is more than 0.2 wt %, influence of the phosphorus component upon the catalytic activity for the exhaust gas becomes greater.

The ashless organic polysulfide compound to be used in the present invention includes organic compounds expressed by the following formulae, such as sulfides of oils or fats or polyolefins, in which a sulfur atom group having two or more sulfur atoms adjoining and bonded together is present in a molecular structure.

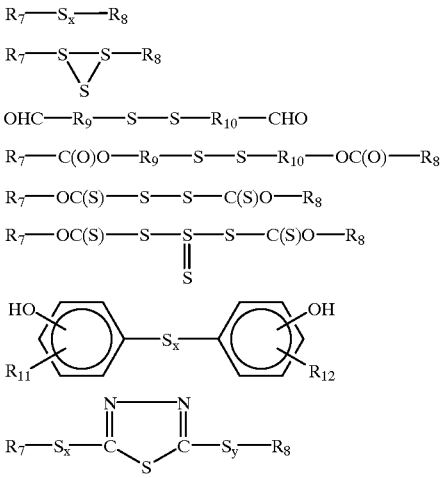

In the above formulae, $R_7$ and $R_8$ independently denote a straight-chain, branched-chain, alicyclic or aromatic hydrocarbon group in which a straight chain, a branched chain, an alicyclic unit and an aromatic unit may be selectively contained in any combined manner. An unsaturated bond may be contained, but a saturated hydrocarbon group is preferred. Among them, alkyl group, aryl group, alkylaryl group, benzyl group, and alkylbenzyl group are preferred.

$R_9$ and $R_{10}$ independently denote a straight-chain, branched-chain alicyclic or aromatic hydrocarbon group which has two bonding sites and in which a straight chain, a branched chain, an alicyclic unit and an aromatic unit may be selectively contained in any combined manner. An unsaturated bond may be contained, but a saturated hydrocarbon group is preferred. Among them, alkylene group is preferred. $R_{11}$ and $R_{12}$ independently denote a straight-chain or branched-chain hydrocarbon group. The subscripts "x" and "y" denote independently an integer of two or more.

Specifically, for example, mention may be made of sulfurized sperm oil, sulfurized pinene oil, sulfurized soybean oil, sulfurized polyolefin, dialkyl disulfide, dialkyl polysulfide, dibenzyl disulfide, di-tertiary butyl disulfide, polyolefin polysulfide, thiadiazole type compound such as bis-alkyl polysulfanyl thiadiazole, and sulfurized phenol. Among these compounds, dialkyl polysulfide, dibenzyl disulfide, and thiadiazole type compound are preferred. Particularly, bis-alkyl polysulfanyl thiadiazole is preferred.

As the lubricant additive, a metal-containing compound such as Ca phenate having a polysulfide bond is used. However, since this compound has a large coefficient of friction, it is not suitable. To the contrary, the above organic polysulfide compound is an ashless compound containing no metal, and exhibits excellent performance in maintaining a low coefficient of friction for a long time when used in combination with MoDTC and ZnDTP.

The above ashless organic polysulfide compound (hereinafter referred to briefly as "polysulfide compound") is added in an amount of 0.01 to 0.4 wt %, preferably 0.1–0.3 wt %, more preferably 0.2–0.3 wt %, when calculated as sulfur (S), relative to the total amount of the engine oil composition. If the addition amount is less than 0.01 wt %, it is difficult to attain the intended effect, whereas if it is more than 0.4 wt %, there is a danger that corrosive wear increase. Needless to say, only one kind of the above polysulfide compound may be used, and two kinds of such polysulfide compounds may also be used in combination.

In order to ensure the performance suitable for the intended use, engine oil additives other than the above may be appropriately added to the engine oil composition according to the present invention so as to improve the total performance. As such engine oil additives, mention may be made of so-called metallic detergents such as sulfonate, phenate and salicylate of alkaline earth metals such as Ca, Mg and Ba and alkali metals such as Na, ashless dispersants such as alkenyl succinic acid imide, succinic acid esters and benzylamine, phenolic anti-oxidant such as bisphenol, amine-based anti-oxidant such as diphenylamine, and viscosity index improvers such as olefin copolymer or polymetacrylate. Further, other engine oil additives such as a pour point depressant, anti-corrosion agent and antifoaming agent may be appropriately added.

The present invention will be explained in more detail with reference to Examples and Comparative Examples.

Experiment 1

A lubricant in each of Examples and Comparative Examples was prepared by using Mineral Oils 1 or 2 having the following properties as a base oil.

TABLE 1

| | Mineral oil 1 | Mineral oil 2 |
|---|---|---|
| Density (15° C.)g/cm$^3$ | 0.862 | 0.821 |
| Dynamic viscosity (40° C.)mm$^2$/s | 17.7 | 19.7 |
| Dynamic viscosity (100° C.)mm$^2$/s | 3.78 | 4.51 |
| Viscosity index | 99 | 147 |
| Flow point (° C.) | −15.0 | −15.0 |
| Content of saturated component (%) | 76.5 | 98.8 |

As additives, the following were used.

(1) MoDTC:

Compound having the above-mentioned formula (1) in which $R_1$ through $R_4$ are all 2-ethylhexyl groups.

(2-1) Sulfur-based additive 1

Sulfur-based additive 1 means an additive containing the polysulfide compound used in the present invention, and includes a thiadiazole type polysulfide compound having the following formula. The content of sulfur in the sulfur-based additive is 36 wt %.

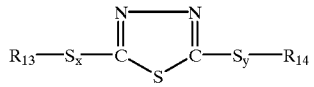

In the formula $R_{13}$ and $R_{14}$ independently denote the same meanings as $R_7$ and $R_8$ do, respectively.

(2-2) Sulfur-based additive 2

Sulfur-based additive 2 means an additives containing a sulfurized oil and fat type polysulfide compounds, and the content of sulfur in the sulfur-based additive 2 is 10.5 wt %.

(2-3) Sulfur-based additive 3:

Sulfur-based additive 3 means an additive containing a dibenzyl disulfide, and the content of sulfur in the sulfur-based additive 3 is 25.5 wt %.

(3-1) ZnDTP1

ZnDTP1 is a primary alkyl compound of the above formula (2) in which $R_5$ and $R_6$ are 2-ethylhexyl groups.

(3-2) ZnDTP2

ZnDTP2 means secondary alkyl compounds of the above formula (2) in which $R_5$ and $R_6$ are isopropyl groups or isohexyl groups or a mixture of these compounds each having the respective two above alkyl groups.

(4) Additive package

Additive package includes metallic detergent, ashless dispersant, phenolic anti-oxidant, amine-based anti-oxidant, viscosity index improver, anti-corrosion agent and antifoaming agent.

The above mentioned base oils and additives were selectively mixed at recipes shown in Table 3, thereby preparing long life and low fuel consumption engine oil compositions according to the present invention as Examples 1 through 5. In the same manner, base oils and additives were selectively mixed at recipes shown in Table 5, thereby preparing engine oil composition as Comparative Examples 1 through 8. In Tables 3 and 5, figures for the ingredients are compounding rates based on the unit "wt %" except that the foaming agent is based on the unit "wt ppm".

The engine oil compositions thus prepared as Examples and Comparative Examples were evaluated with respect to the friction performance and wear characteristic in the valve train system according to the following methods.

(1) Friction Performance

With respect to fresh lubricants and used ones, the coefficient of friction was measured under the following conditions by using an SRV tester. As test pieces, a ball made of SUJ-2 (bearing steel material, Japanese Industrial Standards), and having 10 mm in diameter and a disc made of SUJ-2 were used.

TABLE 2

| | Test conditions | |
|---|---|---|
| | Break in conditions | Actual test conditions |
| Load (N) | 10 | 200 |
| Amplitude (mm) | 1.5 | 1.5 |
| Frequency (Hz) | 50 | 50 |
| Temperature (° C.) | 40 | 80 |
| Time (min) | 10 | 30 |

The coefficient of friction is the average coefficient of friction determined in the friction test during the final 20 minutes.

The used oil compositions are oil compositions obtained when the oil was subjected to running in simulation with an actual car driving. The engine was operated under an AMA running mode at an oil temperature of 100° C. and a water temperature of 100° C., and the engine oil composition was sampled after the lapse of 160 hours (corresponding to 4000 km) and 400 hours (corresponding to 10000 km). The thus obtained used oil compositions were subjected to the above friction test.

(2) Valve Train System Wearing Test

Each engine oil composition was subjected to the valve train system wear test according to JASO (Japanese Automobile Standards Organization) M328-91. Then, scuffing of a rocker arm was evaluated, and a worn amount of a cam nose was measured.

Evaluation results in Examples 1 through 5 are shown in Table 4, and those in Comparative Examples 1 through 8 are shown in Table 6. In Tables 4 and 6, scuffing of the rocker arm was evaluated by using a figure between 1 to 10.0, "1" and "10.0" being the lowest and the highest, respectively.

TABLE 3

| | Example 1 | Example 2 | Example 3 | Example 4 | Example 5 |
|---|---|---|---|---|---|
| Mineral oil 1 | 84.5 | 83.1 | 84.3 | — | 85.0 |
| Mineral oil 2 | — | — | — | 84.5 | — |
| MoDTC additive | 2.0 | 2.0 | 2.0 | 2.0 | 2.0 |
| Content of Mo in oil composition | 0.08 | 0.08 | 0.08 | 0.08 | 0.08 |
| Sulfur-based additive 1 | 0.6 | — | — | 0.6 | 0.6 |
| Sulfur-based additive 2 | — | 2.0 | — | — | — |
| Sulfur-based additive 3 | — | — | 0.8 | — | — |
| Content of Sulfur in oil composition | 0.22 | 0.21 | 0.20 | 0.22 | 0.22 |
| ZnDTP 1 | 1.5 | 1.5 | 1.5 | 1.5 | — |
| ZnDTP 2 | — | — | — | — | 1.0 |

TABLE 3-continued

| | Example 1 | Example 2 | Example 3 | Example 4 | Example 5 |
|---|---|---|---|---|---|
| Content of P in oil composition | 0.095 | 0.095 | 0.095 | 0.095 | 0.090 |
| Metallic detergent | 2.0 | 2.0 | 2.0 | 2.0 | 2.0 |
| Ash-based dispersant | 4.0 | 4.0 | 4.0 | 4.0 | 4.0 |
| Phenolic anti-oxidant | 0.8 | 0.8 | 0.8 | 0.8 | 0.8 |
| Amine-based anti-oxidant | 0.4 | 0.4 | 0.4 | 0.4 | 0.4 |
| Viscosity index improver | 4.0 | 4.0 | 4.0 | 4.0 | 4.0 |
| Corrosion inhibitor | 0.2 | 0.2 | 0.2 | 0.2 | 0.2 |
| Antifoaming agent (ppm) | 5 | 5 | 5 | 5 | 5 |

TABLE 4

| | Example 1 | Example 2 | Example 3 | Example 4 | Example 5 |
|---|---|---|---|---|---|
| Dynamic viscosity (40° C.) $mm^2/sec$ | 53.5 | 54.5 | 52.5 | 51.4 | 54.3 |
| Dynamic viscosity (100° C.) $mm^2/sec$ | 9.4 | 9.5 | 9.3 | 9.8 | 9.5 |
| Viscosity index | 160 | 159 | 161 | 180 | 160 |
| Coefficient of friction | | | | | |
| fresh oil composition | 0.045 | 0.043 | 0.044 | 0.042 | 0.040 |
| used oil composition (160 hrs) | 0.044 | 0.047 | 0.046 | 0.041 | 0.050 |
| used oil composition (400 hrs) | 0.066 | 0.063 | 0.067 | 0.059 | 0.072 |
| Wear of valve-moving system (rocker arm scuffing): Merit rating | 9.0 | 8.6 | 8.7 | 8.6 | 9.2 |
| Wear of cam nose $\mu m$ | 3 | 4 | 5 | 4 | 3 |

TABLE 5

| | Comparative Example 1 | Comparative Example 2 | Comparative Example 3 | Comparative Example 4 | Comparative Example 5 | Comparative Example 6 | Comparative Example 7 | Comparative Example 8 |
|---|---|---|---|---|---|---|---|---|
| Mineral oil 1 | 85.1 | 83.6 | 86.0 | — | 86.5 | 87.6 | 86.6 | 88.0 |
| Mineral oil 2 | — | — | — | 85.1 | — | — | — | — |
| MoDTC additive | 2.0 | 2.0 | 2.0 | 2.0 | — | — | 2.0 | — |
| Content of Mo in oil composition | 0.08 | 0.08 | 0.08 | 0.08 | 0 | 0 | 0.08 | 0 |
| Sulfur additive 1 | — | — | 0.6 | — | 0.6 | — | — | 0.6 |
| Sulfur additive 2 | — | — | — | — | — | — | — | — |
| Sulfur additive 3 | — | — | — | — | — | — | — | |
| Content of Sulfur in oil | 0 | 0 | 0.22 | 0 | 0.22 | 0 | 0 | 0.22 |
| ZnDTP 1 | 1.5 | 3.0 | — | 1.5 | 1.5 | — | — | — |
| ZnDTP 2 | — | — | — | — | — | 1.0 | — | — |
| Content of P in oil | 0.095 | 0.190 | 0 | 0.095 | 0.095 | 0.090 | 0 | 0 |
| Metallic clearing agent | 2.0 | 2.0 | 2.0 | 2.0 | 2.0 | 2.0 | 2.0 | 2.0 |
| Ash-based dispersant | 4.0 | 4.0 | 4.0 | 4.0 | 4.0 | 4.0 | 4.0 | 4.0 |
| Phenolic anti-oxidant | 0.8 | 0.8 | 0.8 | 0.8 | 0.8 | 0.8 | 0.8 | 0.8 |
| Amine-based anti-oxidant | 0.4 | 0.4 | 0.4 | 0.4 | 0.4 | 0.4 | 0.4 | 0.4 |
| Viscosity index improver | 4.0 | 4.0 | 4.0 | 4.0 | 4.0 | 4.0 | 4.0 | 4.0 |
| Corrosion inhibitor | 0.2 | 0.2 | 0.2 | 0.2 | 0.2 | 0.2 | 0.2 | 0.2 |
| Antifoaming agent (ppm) | 5 | 5 | 5 | 5 | 5 | 5 | 5 | 5 |

TABLE 6

| | | Comparative Example 1 | Comparative Example 2 | Comparative Example 3 | Comparative Example 4 | Comparative Example 5 | Comparative Example 6 | Comparative Example 7 | Comparative Example 8 |
|---|---|---|---|---|---|---|---|---|---|
| Dynamic viscosity (40° C.) $mm^2/sec$ | | 51.8 | 55.0 | 51.6 | 49.6 | 52.8 | 50.1 | 48.9 | 48.4 |
| Dynamic viscosity (100° C.) $mm^2/sec$ | | 9.2 | 9.6 | 9.2 | 9.6 | 9.3 | 9.0 | 8.8 | 8.7 |
| Viscosity index | | 161 | 160 | 162 | 182 | 160 | 162 | 161 | 160 |
| Coefficient of friction | fresh oil composition | 0.041 | 0.041 | 0.040 | 0.041 | 0.103 | 0.112 | 0.072 | 0.109 |
| | used oil composition (160 hrs) | 0.061 | 0.040 | 0.058 | 0.052 | 0.113 | 0.113 | 0.091 | 0.109 |
| | used oil composition (400 hrs) | 0.103 | 0.090 | 0.093 | 0.092 | 0.114 | 0.113 | 0.110 | 0.111 |
| Wear of valve-moving system (rocker arm scuffing): Merit rating | | 8.7 | 8.9 | 6.6 | 8.7 | 8.4 | 8.6 | 6.3 | 0 |
| Wear of cam nose $\mu m$ | | 5 | 4 | 19 | 6 | 7 | 5 | 22 | 84 |

Examples 1 through 3 in Table 3 are engine oil compositions which all used Mineral Oil 1 and also employed a thiadiazole compound, a sulfurized oil and fat type compound and dibenzyl disulfide as the polysulfide compound, respectively. Example 4 is the same engine oil composition as in Example 1 except that Mineral Oil 1 was replaced by more highly purified Mineral Oil 2. In Example 5, a secondary alkyl type was used as ZnDTP.

In Table 5, Comparative Example 1 is an engine oil composition containing no polysulfide compound, and Comparative Example 2 is an engine oil composition containing much ZnDTP. Comparative Example 3 is an engine oil composition containing no ZnDTP, and Comparative Example 4 is the same engine oil composition as Comparative Example 1 except that the base oil was replaced by highly purified Mineral Oil 2. Comparative Example 5 is an engine oil composition containing no MoDTC, and Comparative Example 6 is an engine oil composition containing neither MoDTC nor polysulfide compound, and Comparative Example 7 is an engine oil composition containing neither ZnDTP nor polysulfide compound. Comparative Example 8 is an engine oil composition containing neither MoDTC nor ZnDTP.

Comparison between Examples and Comparative Examples in Table 4 and Table 6 reveals that particularly the coefficients of friction of the engine oil compositions in Examples are clearly smaller as compared with those in Comparative Examples after deterioration for 400 hours, though the former do not almost differ from the latter with respect to the fresh engine oil compositions, i.e., changes in the coefficient of friction of the engine oil compositions in Examples are smaller than those in Comparative Examples even after long-term use.

For example, Comparison between Example 1 and Comparative Example 1, between Example 2 and Comparative Example 2 and between Example 4 and Comparative Example 4 reveals that when the polysulfide compound was used in combination, the coefficient of friction particularly after the passage of 400 hours remarkably decreased. Comparison between Example 3 and Comparative Example 3 reveals that in Comparative Example 3, since no ZnDTP was used in combination, the coefficient of friction after the passage of 400 hours was not only high, but also the worn amount of the cam nose conspicuously increased. Comparison between Example 5 and Comparative Examples 5 and 6 reveals that in Comparative Examples 5 and 6, since no MoDTC was used in combination, the coefficient of friction was high from the beginning. In Comparative Example 7, since neither ZnDTP nor polysulfide compound were used in combination, the coefficient of friction with the passage of 400 hours was not only high, but also the worn amount of the cam nose conspicuously increased. In Comparative Example 8, since neither MoDTC nor ZnDTP were used in combination, the coefficient of friction was not only high from the beginning, but also the worn amount of the cam nose was extremely high.

Experiment 2

Engine oil compositions in the following Example 6 and Comparative Example 9 were prepared in the same manner as the examples described in Experiment 1 above. The numbers in the following Table 7 are parts by weight. The same base oil and the same additives as those recited in Experiment 1 were used in Experiment 2 except that a phenolic antioxidant was used as the antioxidant.

TABLE 7

| | Example 6 | Comparative Example 9 |
|---|---|---|
| Mineral oil 1 | 83.98 | 84.06 |
| MoDTC | 0.73 | 0.73 |
| Content of Mo* | 0.03 | 0.03 |
| Sulfur-based additive 1 | 0.08 | — |
| Content of sulfur* | 0.03 | — |
| ZnDTP2 | 0.51 | 0.51 |
| Content of phosphorus* | 0.04 | 0.04 |
| Metallic detergent | 3.0 | 3.0 |
| Ashless dispersant | 6.0 | 6.0 |
| Antioxidant | 1.0 | 1.0 |
| Viscosity index improver | 4.5 | 4.5 |
| Corrosion inhibitor | 0.2 | 0.2 |
| Antifoaming agent | 5 ppm | 5 ppm |

*in the engine oil composition

A fresh engine oil composition and a deteriorated engine oil composition for each of Example 6 and Comparative Example 9 were evaluated by using an SRV tester. Results are shown in Table 8 and the test condition is shown in Table 9. As each test tool, a disc and a cylinder were used. Both of the disc and the cylinder were made of SUJ-2, and the cylinder had a diameter 15 mm and a length of 22 mm.

TABLE 8

| | Example 6 | Comparative Example 9 |
|---|---|---|
| Kinematic Viscosity 40° C. | 53.0 | 54.1 |
| Kinematic Viscosity 100° C. | 9.52 | 9.65 |
| Viscosity index | 166 | 165 |
| Coefficient of friction | | |
| Fresh oil composition | 0.039 | 0.042 |
| deteriorated oil composition (48 hrs) | 0.065 | 0.076 |

TABLE 9

| Test condition: | |
|---|---|
| Load (N) | 400 |
| Amplitude (mm) | 1.5 |
| Frequency (Hz) | 50 |
| Temperature (° C.) | 80 |
| time period (min.) | 20 |

The deteriorated oil was prepared by a method different from that described in Experiment 1. That is, the method in Experiment 1 uses 4 liters of an engine oil composition subjected to simulated running with an actual car driving with the engine operating under an AMA running mode at an oil temperature of 100° C. and a water temperature of 100° C. In the method used in Experiment 2, a half volume (2 liters) of an engine oil composition is subjected to an accelerated running test under the same conditions so as to shorten the testing time period.

The time period for deteriorating the engine oil composition was 48 hours, which corresponds to about 3000 km.

Changes in the coefficient of friction with lapse of the testing time period are shown in FIG. 1. The testing time periods of 24, 48, 72, and 96 hours correspond to approximate running distances of 1500 km, 3000 km, 4500 km, and 6000 km, respectively.

As is clear from the above, Example 6 suppresses the coefficient of friction to a low level over an extended time period as compared with Comparative Example 9, which means that the fuel efficiency durability of the engine oil composition can be improved. Further, it is clear that although the addition amount of MoDTC was smaller in Example 6 than in Comparative Examples 1–3, Example 6 can reduce friction for substantially the same time period.

Experiment 3

Engine oil compositions in the following Examples 7–9 and Comparative Examples 10–13 were prepared in the same manner as the Examples and Comparative Examples described in Experiment 2. The numbers in the following Table 10 are parts by weight. Table 10 combines the engine oil composition data of Experiment 2 and Experiment 3. The same base oil and the same additives as those recited in Experiment 2 were used in Experiment 3 except that "MoDTC2" was used as MoDTC in Examples 8 and 9 and Comparative Examples 11 and 12, rather than the above-mentioned MoDTC compound ("MoDTC1" in Table 10) of formula (1) in which $R_1$ through $R_4$ are all 2-ethylhexyl groups, as in Examples 1–7 and Comparative Examples 1–10. MoDTC2 is a mixture of a MoDTC in which $R_1$ through $R_4$ are all 2-ethylhexyl groups; a MoDTC in which $R_1$ through $R_4$ are all isotridecyl groups; and a MoDTC in which $R_1$ and $R_2$ are 2-ethylhexyl groups, while $R_3$ and $R_4$ are isotridecyl groups.

TABLE 10

| | Example 6 | Example 7 | Example 8 | Example 9 | Comparative Example 9 | Comparative Example 10 | Comparative Exampie 11 | Comparative Example 12 | Comparative Example 13 |
|---|---|---|---|---|---|---|---|---|---|
| Mineral oil 1 | 83.98 | 83.52 | 81.76 | 79.22 | 84.06 | 83.68 | 82.45 | 80.11 | 83.93 |
| MoDTC 1 | 0.73 | 0.98 | — | — | 0.73 | 0.98 | — | — | — |
| MoDTC 2 | — | — | 1.78 | 3.56 | — | — | 1.78 | 3.56 | — |
| MoDTP | — | — | — | — | — | — | — | — | 0.57 |
| Content of Mo | 0.03 | 0.04 | 0.08 | 0.16 | 0.03 | 0.04 | 0.08 | 0.16 | 0.04 |
| Sulfur-based additive 1 | 0.08 | 0.16 | 0.39 | 0.89 | — | — | — | — | 0.16 |
| Content of sulfur | 0.03 | 0.06 | 0.14 | 0.32 | — | — | — | — | 0.06 |
| ZnDTP 2 | 0.51 | 0.64 | 1.27 | 2.03 | 0.51 | 0.64 | 1.27 | 2.03 | 0.64 |
| Content of phosphorous | 0.04 | 0.05 | 0.10 | 0.16 | 0.04 | 0.05 | 0.10 | 0.16 | 0.05 |
| S/Mo | 1 | 1.5 | 1.75 | 2 | 0 | 0 | 0 | 0 | 1.5 |
| P/Mo | 1.33 | 1.25 | 1.25 | 1.00 | 1.33 | 1.25 | 1.25 | 1.00 | 1.25 |
| Metallic detergent | 3.0 | 3.0 | 3.0 | 3.0 | 3.0 | 3.0 | 3.0 | 3.0 | 3.0 |
| Ashless dispersant | 6.0 | 6.0 | 6.0 | 6.0 | 6.0 | 6.0 | 6.0 | 6.0 | 6.0 |
| Antioxidant | 1.0 | 1.0 | 1.0 | 1.0 | 1.0 | 1.0 | 1.0 | 1.0 | 1.0 |
| Viscosity index improver | 4.5 | 4.5 | 4.3 | 4.1 | 4.5 | 4.5 | 4.3 | 4.1 | 4.5 |
| Corrosion inhibitor | 0.2 | 0.2 | 0.2 | 0.2 | 0.2 | 0.2 | 0.2 | 0.2 | 0.2 |
| Antifoaming agent | 5 ppm | 5 ppm | 5 ppm | 5 ppm | 5 ppm | 5 ppm | 5 ppm | 5 ppm | 5 ppm |

A fresh engine oil composition and a deteriorated engine oil composition for each of Examples 7–9 and Comparative Examples 10–13 were evaluated by using an SRV tester. Results are shown in Table 11, along with results obtained under identical test conditions in Experiment 2 with Example 6 and Comparative Example 9.

TABLE 11

| | | Example 6 | Example 7 | Example 8 | Example 9 | Comparative Example 9 | Comparative Example 10 | Comparative Example 11 | Comparative Example 12 | Comparative Example 13 |
|---|---|---|---|---|---|---|---|---|---|---|
| Kinematic viscosity (40° C.) $mm^2/sec$ | | 53.0 | 54.6 | 54.8 | 54.1 | 54.1 | 55.1 | 55.3 | 54.9 | 54.5 |
| Kinematic viscosity (100° C.) $mm^2/sec$ | | 9.52 | 9.66 | 9.72 | 9.66 | 9.65 | 9.70 | 9.79 | 9.77 | 9.64 |
| Viscosity index | | 166 | 163 | 164 | 165 | 165 | 163 | 164 | 165 | 163 |
| Coefficient of friction | Fresh oil composition | 0.039 | 0.038 | 0.045 | 0.043 | 0.042 | 0.039 | 0.041 | 0.042 | 0.043 |
| | Deteriorated oil composition (48 hrs) | 0.065 | 0.048 | 0.043 | 0.044 | 0.076 | 0.047 | 0.044 | 0.043 | 0.077 |
| | Deteriorated oil composition (72 hrs) | — | 0.048 | 0.045 | 0.043 | — | 0.071 | 0.055 | 0.043 | 0.130 |
| | Deteriorated oil composition (144 hrs) | — | — | 0.057 | 0.043 | — | — | 0.087 | 0.043 | — |
| | Deteriorated oil composition (288 hrs) | — | — | — | 0.052 | — | — | — | 0.086 | — |

The data in Table 11 demonstrate that the coefficient of friction after a given time period for each of Examples 6–9 were suppressed lower than those of corresponding Comparative Examples 9–12 and that of Comparative Example 13 (conventional MoDTP). As is seen from the results in Table 11, as the content of the MoDTC increases, the time period during which the oil composition can be satisfactorily used increases.

FIGS. 2A–2D show a comparison of the friction coefficient versus time of the oil compositions in the Examples and Comparative Examples in Table 11.

FIGS. 2A–2D, along with FIG. 1, point to unexpected improved friction properties achieved by the engine oil composition of the present invention over a critical range of MoDTC concentration between 50 ppm and 2000 ppm. Within this critical range of MoDTC concentration, the engine oil composition of the present invention unexpectedly exhibits an advantageously reduced friction coefficient over extended time periods, when compared with conventional oil compositions.

The critical range over which the engine oil composition of the present invention is advantageous, in comparison with conventional oil compositions, can be discerned as follows. As discussed above, if MoDTC is added in an amount less than 50 ppm by weight, the friction-reducing effect is small. Thus, for such samples, a friction coefficient versus time curve for the oil composition of the present invention and a friction coefficient versus time curve for a conventional oil composition, analogous to the curves in FIG. 1, would superimpose on each other. In other words, when the MoDTC concentration is less than 50 ppm, there is no difference in the friction coefficient versus time curves for the inventive oil composition and a conventional oil composition.

Similarly, when MoDTC is present in an oil composition at a concentration of more than 2000 ppm by weight, a friction coefficient versus time curve for the oil composition of the present invention would superimpose on the friction coefficient versus time curve for a conventional oil composition. This is because, as discussed above, when the MoDTC concentration is more than 2000 ppm, the friction-reducing effect is saturated. Thus, when the MoDTC concentration is more than 2000 ppm, there will be no difference in the friction coefficient versus time curves for the inventive oil composition and a conventional oil composition.

However, in the critical range of MoDTC concentration between 50 ppm and 2000 ppm, as shown in FIG. 1 and suggested in FIGS. 2A–2D, there is a substantial difference between the friction coefficient versus time curve for the oil composition of the present invention and the friction coefficient versus time curve for a conventional comparative oil composition. This difference in the curves reflects the advantageous improved friction properties achieved over extended time periods in engine oil compositions according to the present invention. While this advantage is zero below 50 ppm and above 2000 ppm, this advantage peaks in the critical range between 50 ppm and 2000 ppm.

There is nothing in the conventional art that teaches or suggests the peak in the friction property advantage achieved by the present engine oil composition, relative to conventional engine oil compositions, over the critical range of MoDTC concentration between 50 ppm and 2000 ppm. This result is quite unexpected.

Comparative Example 13 shows that when MoDTP is substituted for MoDTC, contrary to the present invention, the advantageous reduction in friction coefficient obtained by the engine oil composition of the present invention is not achieved.

The engine oil composition of the present invention is characterized in that MoDTC and ZnDTP are combined with the ashless organic polysulfide compound in the respectively specified addition amounts, and that a low coefficient of friction can be maintained in a long-term use even without addition of a large amount of particularly MoDTP or ZnDTP. Therefore, when the engine oil composition according to the present invention is charged into and used in the automobile, splendid effects can be exhibited with respect to fuel consumption saving and environmental maintenance.

What is claimed is:

1. An engine oil composition comprising:

at least one base oil selected from the group consisting of a mineral oil and a synthetic oil lubricant;

a molybdenum dithiocarbamate (MoDTC) in an amount of 50 to 2000 ppm by weight when calculated as molybdenum (Mo), relative to the total weight of the engine oil composition;

zinc dithiophosphate (ZnDTP) in an amount of 0.01 to 0.2 wt % when calculated as phosphorus (P), relative to the total amount of the engine oil composition; and an ashless organic polysulfide compound in an amount of 0.01 to 0.4 wt % when calculated as sulfur (S), relative to the total amount of the engine oil composition, wherein said ashless organic polysulfide compound is selected from the group consisting of:

(i) a thiadiazole type polysulfide compound having the following formula:

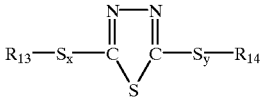

wherein $R_{13}$ and $R_{14}$ independently denote a straight-chain, branched-chain, alicyclic, or aromatic hydrocarbon group, and x and y independently denote an integer of two or more, and (ii) a dibenzyl disulfide.

2. The engine oil composition claimed in claim 1, wherein said molybdenum dithiocarbamate (MoDTC) is a compound expressed by the following formula

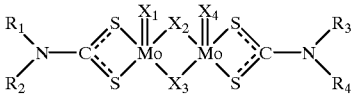

in which $R_1$ through $R_4$ independently denote a straight-chain or branched-chain alkyl group or a straight-chain or branched-chain alkenyl group having four to eighteen carbons; and $X_1$ through $X_4$ independently denote an oxygen atom or a sulfur atom, the ratio between the number of the oxygen atom or atoms and that of the sulfur atom or atoms with respect to $X_1$ through $X_4$ being 1/3 to 3/1.

3. The engine oil composition claimed in claim 2, wherein said $R_1$ through $R_4$ independently denote the alkyl group.

4. The engine oil composition claimed in claim 2, wherein each of said $R_1$ through $R_4$ independently denotes a butyl group, a 2-ethylhexyl group, an isotridecyl group or a stearyl group.

5. The engine oil composition claimed in claim 1, wherein said MoDTC is used in the addition amount of 300 to 1000 ppm by weight, when calculated as molybdenum (Mo), relative to the total weight of the engine oil composition.

6. The engine oil composition claimed in claim 1, wherein said zinc dithiophosphate (ZnDTP) is a compound expressed by the following formula

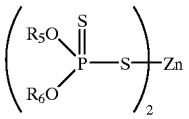

in which each of $R_5$ and $R_6$ independently denotes a straight-chain or branched chain alkyl group or an aryl group having three to eighteen carbon atoms.

7. The engine oil composition claimed in claim 6, wherein said $R_5$ and $R_6$ independently denote an alkyl group.

8. The engine oil composition claimed in claim 6, wherein said $R_5$ and $R_6$ independently denote a primary alkyl group.

9. The engine oil composition claimed in claim 6, wherein said $R_5$ and $R_6$ independently denote propyl group, butyl group, pentyl group, hexyl group, octyl group or lauryl group.

10. The engine oil composition claimed in claim 6, wherein said ZnDTP is added in an amount of 0.04 to 0.2 wt %.

11. The engine oil composition claimed in claim 1, wherein said ashless organic polysulfide compound is added in an amount of 0.1–0.3 wt % when calculated as sulfur (S), relative to the total amount of the engine oil composition.

12. The engine oil composition claimed in claim 1, wherein said molybdenum dithiocarbamate (MoDTC) is present in an amount of 300 to 1000 ppm by weight when calculated as molybdenum (Mo), relative to the total weight of the engine oil composition; said zinc dithiophosphate is present in an amount of 0.04 to 0.2 wt % when calculated as phosphorus (P), relative to the total amount of the engine oil composition; and said ashless organic polysulfide compound is present in an amount of 0.1 to 0.3 wt % when calculated as sulfur (S), relative to the total amount of the engine oil composition.

13. A method of making an engine oil composition comprising:

combining at least one base oil selected from the group consisting of a mineral oil and a synthetic oil lubricant;

a molybdenum dithiocarbamate (MoDTC) in an amount of 50 to 2000 ppm by weight when calculated as molybdenum (Mo), relative to the total weight of the engine oil composition;

zinc dithiophosphate (ZnDTP) in an amount of 0.01 to 0.2 wt % when calculated as phosphorus (P), relative to the total amount of the engine oil composition; and an ashless organic polysulfide compound in an amount of 0.01 to 0.4 wt % when calculated as sulfur (S), relative to the total amount of the engine oil composition, wherein said ashless organic polysulfide compound is selected from the group consisting of:

(i) a thiadiazole type polysulfide compound having the following formula:

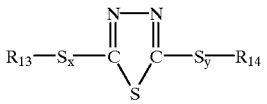

wherein $R_{13}$ and $R_{14}$ independently denote a straight-chain branched-chain, alicyclic, or aromatic hydrocarbon group, and x and y independently denote an integer of two or more, and (ii) a dibenzyl disulfide.

14. An engine oil composition produced by the process of combining at least one base oil selected from the group consisting of a mineral oil and a synthetic oil lubricant;

a molybdenum dithiocarbamate (MoDTC) in an amount of 50 to 2000 ppm by weight when calculated as molybdenum (Mo), relative to the total weight of the engine oil composition;

zinc dithiophosphate (ZnDTP) in an amount of 0.01 to 0.2 wt % when calculated as phosphorus (P), relative to the total amount of the engine oil composition; and an ashless organic polysulfide compound in an amount of 0.01 to 0.4 wt % when calculated as sulfur (S), relative to the total amount of the engine oil composition, wherein said ashless organic polysulfide compound is selected from the group consisting of:

(i) a thiadiazole type polysulfide compound having the following formula:

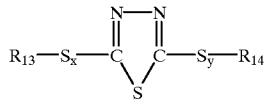

wherein $R_{13}$ and $R_{14}$ independently denote a straight-chain, branched-chain, alicyclic, or aromatic hydrocarbon group, and x and y independently denote an integer of two or more, and (ii) a dibenzyl disulfide.

15. An engine oil composition comprising the following components:

at least one oil selected from the group consisting of a mineral oil and a synthetic lubricant as a base oil;

a molybdenum dithiocarbamate (MoDTC) in an amount of 50 to 2000 ppm by weight when calculated as molybdenum (Mo), relative to the total weight of the engine oil composition;

zinc dithiophosphate (ZnDTP) in an amount of 0.01 to 0.2 wt % when calculated as phosphorus (P), relative to the total amount of the engine oil composition; and an ashless organic polysulfide compound in an amount of 0.01 to 0.4 wt % when calculated as sulfur (S), relative to the total amount of the engine oil composition, wherein said molybdenum dithiocarbamate (MoDTC) is a compound expressed by the following formula

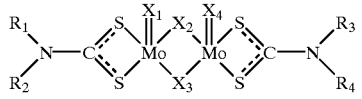

in which $R_1$ through $R_4$ independently denote a straight-chain or branched-chain alkyl group or a straight-chain or branched-chain alkenyl group having four to eighteen carbons; and $X_1$ through $X_4$ independently denote an oxygen atom or a sulfur atom, the ratio between the number of the oxygen atom or atoms and that of the sulfur atom or atoms with respect to $X_1$ through $X_4$ being 1/3 to 3/1; and wherein said ashless organic polysulfide compound is selected from the group consisting of:

(i) a thiadiazole type polysulfide compound having the following formula:

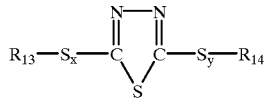

wherein $R_{13}$ and $R_{14}$ independently denote a straight-chain, branched-chain, alicyclic, or aromatic hydrocarbon group, and x and y independently denote an integer of two or more, and (ii) a dibenzyl disulfide.

16. A method of making an engine oil composition comprising combining the components of claim 15.

17. An engine oil composition produced by the method according to claim 16.

18. The engine oil composition claims in claim 1, wherein said ashless organic polysulfide compound is a thiadiazole type polysulfide compound having the following formula:

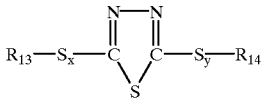

wherein $R_{13}$ and $R_{14}$ independently denote a straight-chain, branched-chain, alicyclic, or aromatic hydrocarbon group, and x and y independently denote an integer of two or more.

19. The engine oil composition claims in claim 1, wherein said ashless organic polysulfide compound is a dibenzyl disulfide.

* * * * *